United States Patent [19]

Zauss

[11] 4,142,470

[45] Mar. 6, 1979

[54] DIESEL LOCOMOTIVE FUEL TANK VENT

[75] Inventor: Louis V. Zauss, Western Springs, Ill.

[73] Assignee: General Motors Corporation, Detroit, Mich.

[21] Appl. No.: 860,954

[22] Filed: Dec. 15, 1977

[51] Int. Cl.[2] ..... B61C 17/02; F17D 1/08

[52] U.S. Cl. ..... 105/26 R; 137/593; 137/574; 137/575; 220/85.8; 220/373; 280/5 R

[58] Field of Search ..... 244/135 R, 135 C; 105/236, 26 R, 1 R; 137/587, 593, 574, 575; 220/85 S, 85 VR, 85 VS, 373, 374, 86 R; 280/5 R, 5 A

[56] References Cited

U.S. PATENT DOCUMENTS

| | | | |
|---|---|---|---|
| 758,078 | 4/1904 | Jardine | 137/574 |
| 1,351,259 | 8/1920 | Maschek et al. | 137/587 X |
| 1,545,352 | 7/1925 | Rodriguez | 220/85 VR |
| 1,653,387 | 12/1927 | Brown | 220/85 VR |
| 2,519,320 | 8/1950 | Meldrum | 105/416 |
| 2,591,848 | 4/1952 | McClean | 105/35 |
| 3,187,935 | 6/1965 | Lense | 220/86 R |
| 3,610,220 | 10/1971 | Yamada | 280/5 A |
| 3,643,690 | 2/1972 | Sarai | 220/86 R X |
| 3,800,978 | 4/1974 | Sigwald | 220/85 VS X |
| 3,844,264 | 10/1974 | Grainger | 220/85 UR X |
| 3,854,416 | 12/1974 | Pelabon | 105/26 R |
| 3,907,153 | 9/1975 | Mutty | 220/86 R |
| 3,981,156 | 9/1976 | Modisette et al. | 220/85 VR X |

OTHER PUBLICATIONS

Figures 0-1 and 1-1 from: Feb. 1968, 4th Ed. of SD4S Operator's Manual Published by Electro-Motive Division of General Motors Corp.

*Primary Examiner*—William Price
*Assistant Examiner*—Allan N. Shoap
*Attorney, Agent, or Firm*—Robert J. Outland

[57] ABSTRACT

A vent and pressure relief system for locomotive fuel tanks includes a short standpipe supporting a baffled overflow vessel connected with a drain conduit. The standpipe is made high enough to prevent the overflow of the fuel therefrom during all operating and braking conditions of the locomotive, except for the moment of high deceleration which occurs only at the instant of a full stop. The overflow vessel is made large enough to contain any overflow of fuel from the standpipe occurring during a full stop, and includes baffling to prevent the loss of fuel out the drain conduit and fuel return means to return spilled fuel to the tank. The standpipe, overflow vessel and drain conduit are made large enough to provide an overflow path that prevents tank overpressure when filling, should the automatic equipment of the filling station fail to cut off when the fuel tank is full.

3 Claims, 3 Drawing Figures

DIESEL LOCOMOTIVE FUEL TANK VENT

BACKGROUND OF THE INVENTION

This invention relates to fuel tank vent systems in diesel locomotives and, more particularly, to an improved fuel tank vent mountable under the locomotive carbody and capable of preventing fuel spills under normal locomotive operating conditions and also of preventing fuel tank damage due to overfilling.

It is common practice for a diesel electric railway locomotive to be provided with a large fuel tank supported beneath the locomotive underframe intermediate the trucks on which the underframe is carried. Such fuel tanks vary with the type and size of locomotive but commonly extend for substantially the width of the carbody and for varying lengths longitudinally thereof, up to twenty feet in one current model in which the fuel tank has a volume capacity of four thousand gallons of diesel fuel.

The fuel tank is connected to supply fuel to the locomotive engine in conventional fashion and includes one or more filler openings through which the tank may be filled at flow rates up to about four hundred gallons per minute by filling equipment provided at filling stations at various locations on the railroads. To avoid spillage, the filling nozzle is screwed or otherwise sealingly secured to the tank filler flange and the filling equipment is provided with automatic cutoff devices to turn off the flow of fuel when the tank reaches a filled condition, as indicated by a sudden rise in pressure.

In order to allow the filling and emptying of the fuel tank in normal use, it is commonly provided with a venting and pressure relief system opening through an upper surface of the tank to connect the interior of the tank with the atmosphere. The vent system is arranged to provide for free flow of air into or out of the tank and to prevent the spilling of any fuel from the tank through the vent under all normal locomotive operating conditions, including emergency stops. The vent also prevents damage to the tank due to overfilling by allowing the overflow of excess fuel should the automatic shutoff on the filling equipment fail to operate properly. The latter feature requires that the vent utilize relatively large openings and pipes on the order of two and a half inches diameter in order that excess fuel may pass out through the vent system at the rate delivered by the filling equipment without creating a pressure in the tank sufficient to deform its outer walls.

In the past, the vent requirement for a majority of diesel-electric locomotives has been met by the use of a long standpipe connected at a suitable point on the top of the tank, generally near one end, and extending upwardly at a suitable location to a point high enough to prevent fuel from reaching the top of the standpipe under all conditions of locomotive operation. The piping then turned downward, extending to a point beneath the carbody and outside the rails to conduct any overflow of fuel during filling to a suitable external point. In order to accomplish the aforementioned purposes, the standpipe was required to extend above the floor of the associated locomotive carbody and thus it was necessary to provide openings in the locomotive floor to accept the vent piping extending upwardly from the tank and downwardly again to a location below the locomotive underframe.

SUMMARY OF THE INVENTION

I have discovered that the acceleration characteristics of a locomotive in normal operation are such that a different form of vent system may be provided to accomplish the desired purposes, which reduces both the cost of materials and labor in the installation, and I have provided a new design of vent system to accomplish this purpose.

My discovery involved tests of railway locomotives which showed that, even under emergency stop conditions, a maximum deceleration rate of about 5.5 miles per hour per second was reached only at the instant at which the locomotive came to a complete stop. During all prior portions of an emergency stop, the deceleration rate did not exceed about 1.2 miles per hour per second. It is, of course, obvious that in braking locomotives or trains in other than emergency conditions and under all conditions of normal locomotive or train acceleration, the rate of acceleration or deceleration would not exceed the emergency braking rate.

From this discovery, it was concluded that the complete prevention of fuel spillage from a tank mounted standpipe could be accomplished under all operating conditions, except at the instant of a complete stop of a locomotive, by a standpipe much smaller than that previously provided and capable of being mounted in the space available between the bottom of the locomotive underframe to which the fuel tank is attached and the carbody floor which is mounted on the top of the underframe. Furthermore, the small amount of fuel which would overflow such a short standpipe during the higher acceleration reached at the instant of complete stop, could be contained by a small overflow reservoir which, if provided with suitable return means, would then return the overflowed fuel back to the fuel tank.

Thus, there was developed a suitable underfloor vent system involving a short standpipe with attached overflow vessel mounted on the fuel tank beneath the locomotive carbody floor. The overflow vessel is provided with fuel return means and a drain conduit, with suitable baffling to prevent fuel from reaching the drain conduit unless the volume exceeds that which the overflow vessel is designed to contain.

With this system, the amount of piping in the vent system is reduced and the necessity for providing openings in the carbody floor is avoided with a savings in both material and labor for installation of the system.

These and other advantages of the arrangement will be more fully understood from the following description of a preferred embodiment taken together with the accompanying drawings.

DESCRIPTION OF THE PREFERRED EMBODIMENT

Figure 1:
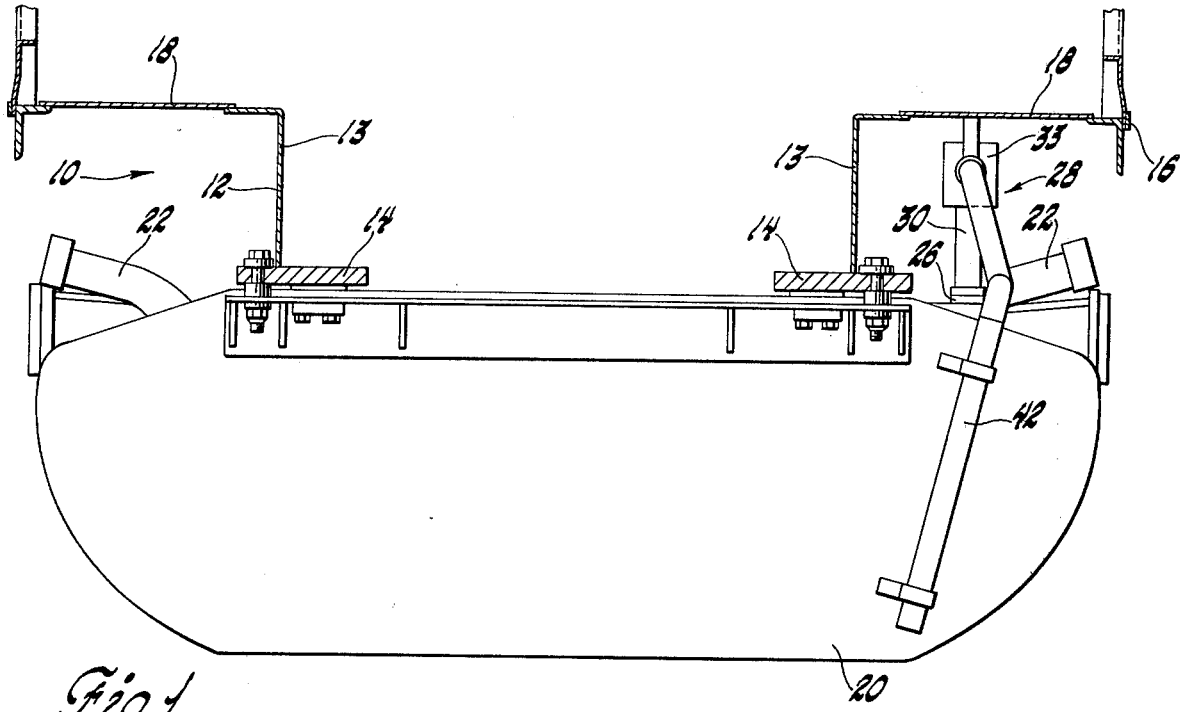
FIG. 1 is a fragmentary cross-sectional view of a locomotive showing the underframe, carbody and fuel tank having a vent system according to the present invention.
Figure 2:
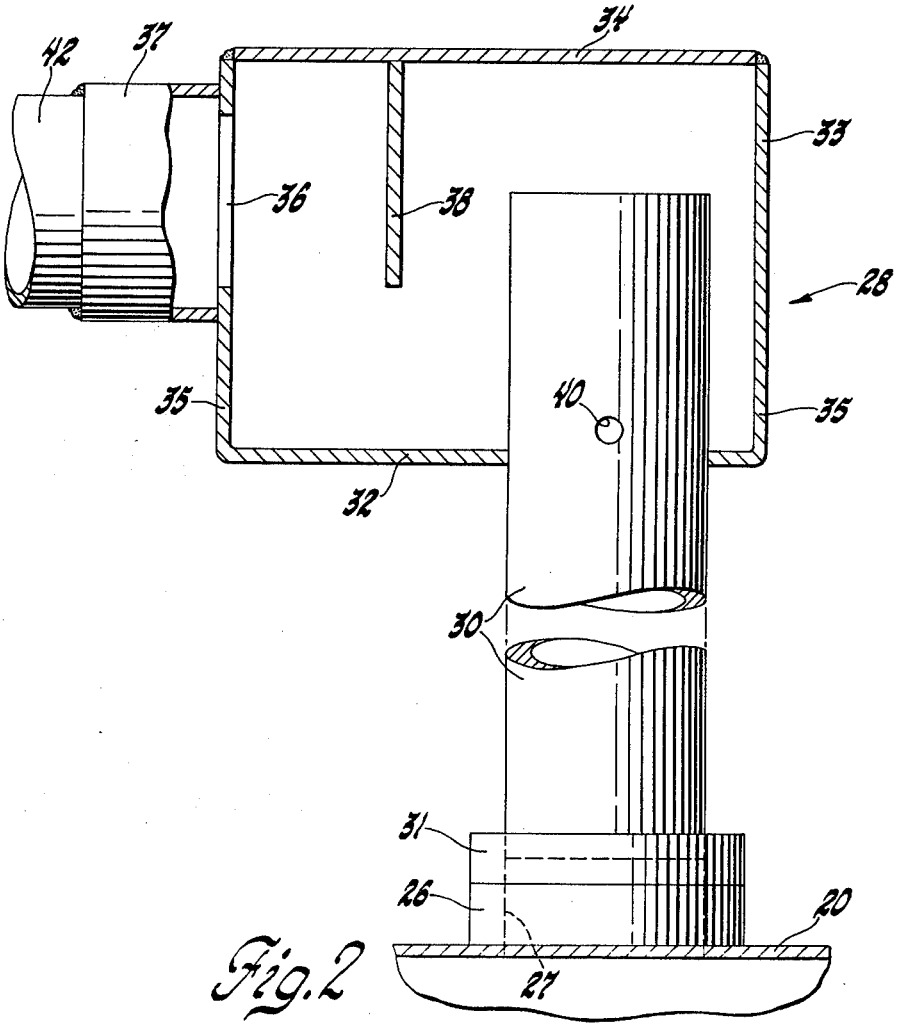
FIG. 2 is a side view of the main elements of the fuel tank vent system having portions broken away to show the interior of the overflow vessel.
Figure 3:
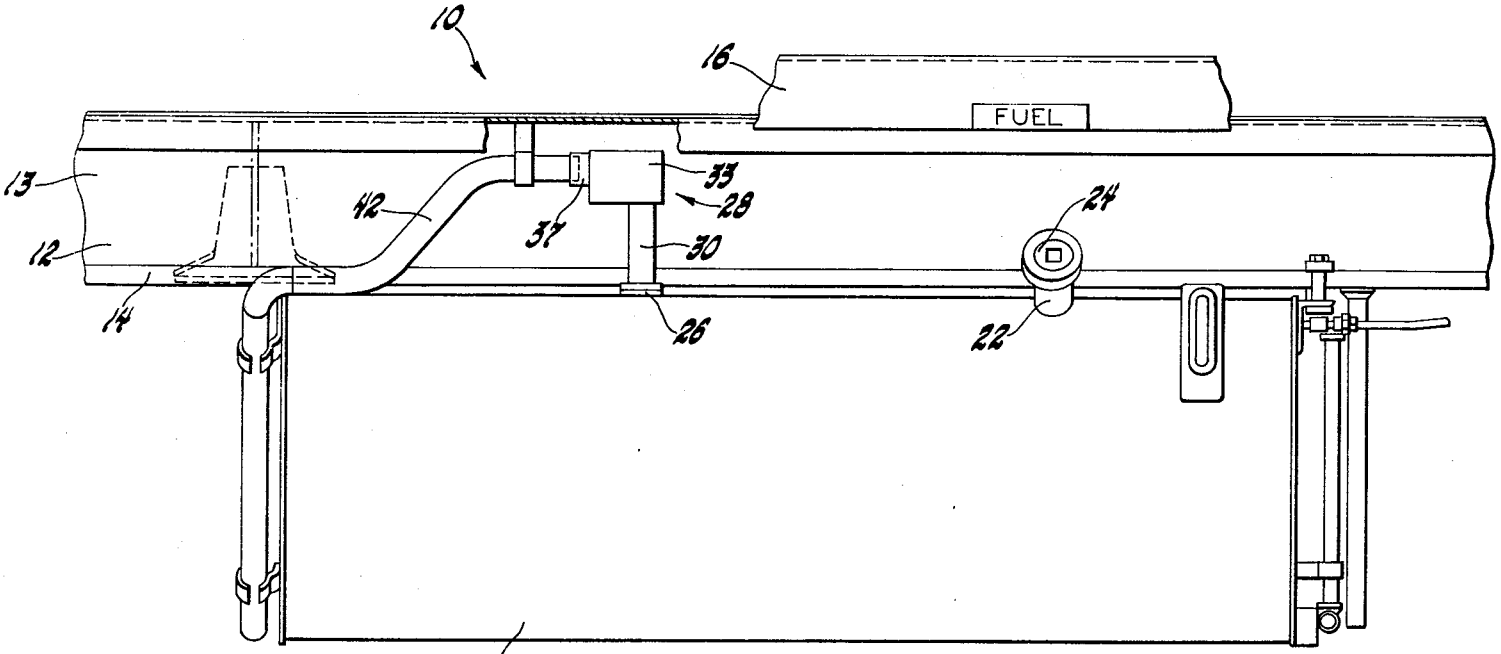
FIG. 3 is a fragmentary side view of the locomotive of FIG. 1 showing further details of the fuel tank and vent system.

In the drawings, numeral 10 generally indicates a diesel-electric locomotive similar to those used for passenger, freight and road switcher service on many railroads of the United States. Locomotive 10 is conventionally provided with a pair of wheeled rail engaging trucks, not shown, supporting at longitudinally spaced locations an underframe 12 having longitudinally extending channels 13 and center sills 14. The underframe in turn supports a carbody 16 having floor portions 18 extending outwardly from the top of the underframe 12 to the sides of the carbody 16.

Secured to the bottom of the underframe in conventional fashion is a diesel fuel tank 20. Tank 20 extends downwardly to a suitable clearance height above the rails, laterally for a width approximately equal to that of the locomotive carbody and longitudinally for a distance which is a function of its volume capacity. This length may be from about twelve feet for a two thousand four hundred gallon tank up to about twenty feet for a four thousand gallon tank. The tank is provided with suitable internal baffles, not shown, and with at least one filler tube and securing flange 22 having a threaded opening normally closed with a plug 24.

Near one side of the tank 20 and spaced somewhat from one end thereof, the fuel tank is provided with a mounting pad 26 that defines a vent opening 27 in the top of the tank. Pad 26 is located at a point outside the locomotive underframe and beneath the carbody floor where the space above the pad is free of other equipment such as air tanks or the like.

Secured to the pad 26 is a fuel tank vent and pressure relief system hereafter referred to as a vent 28. Vent 28 is designed for installation on a family of locomotive fuel tanks having capacities up to four thousand gallons where the mounting location of the vent reaches an extreme of about sixteen feet from the end of the tank. The vent includes a relatively short standpipe 30 secured by a flange 31 to the mounting pad 26 and extending vertically upwardly beneath the floor 18 of the locomotive carbody. The upper end of the standpipe extends through the flat bottom 32 of an enclosed box-like reservoir or overflow vessel 33 to a point within the vessel spaced beneath the top 34 thereof. Vessel 33 is provided in one of its side walls 35 with an outlet opening 36 leading to a short tubular connector 37. A baffle 38 extends downwardly from the top 34 of the vessel to a height about even with the bottom of the outlet opening 36, which point is below the top of the standpipe 30. Near the bottom of the vessel a small return opening 40 is provided in the wall of the standpipe.

Externally of vent 28, the system includes piping comprising a drain conduit 42 which extends from connector 37 longitudinally above and along the top of the tank 20 and downwardly at the end thereof to a point near the bottom of the tank and outwardly of the location of the rails, not shown, on which the locomotive rests.

In order to accomplish the desired purposes, the sizes of the standpipe 30, drain conduit 42 and the passages within the vessel 33 connecting the standpipe with the piping must be made large enough to permit fuel flow therethrough at a rate equal to the maximum fill rate of equipment used to fill the locomotive fuel tank without permitting the development of pressure in the tank great enough to permanently deform the walls thereof. In addition, the standpipe must extend above the tank to a height sufficient to prevent any loss of fuel during a maximum sustained emergency brake deceleration prior to the instant of locomotive stopping and the reservoir or overflow vessel must have a sufficient volume below the level of the outlet opening to contain the total volume of fuel which may surge over the top of the standpipe due to the higher accelerations sustained at the instant of locomotive stopping.

When these requirements are met, the operation of the system is as follows. When the locomotive is accelerated or braked, except at the instant of coming to a complete stop, the pressure rise in the fuel tank at its vent opening, due to locomotive acceleration, is limited to an amount which lifts the fuel only to a point below the top of the standpipe. Thus, even during emergency braking, no fuel overflows the top of the standpipe until the instant of stopping. At this point, a momentarily higher rate of deceleration occurs which may cause a surge of fuel over the top of the standpipe and into the overflow vessel. The overflowed fuel is deflected by the baffle 38 to the bottom of the overflow vessel 33 where it immediately begins to flow back into the tank through the small return opening 40 leading from the overflow vessel to the interior of the standpipe. Thus, no fuel is spilled from the fuel tank vent system even during an emergency stop.

In order to refuel the locomotive, the nozzle of an automatic fuel delivery pump is threaded into the tank filler tube and flange 22 forming a snug connection. Thus venting of the tank during filling is accomplished through the vent 28. The filling equipment is provided with an automatic mechanism to cut off the flow of fuel into the tank at such time as it is full. However, should this mechanism fail, the vent system will prevent the tank from being damaged by overfilling by allowing fuel to flow out through the standpipe, overflow vessel and drain conduit at a rate equal to the filling rate without the pressure in the tank reaching a point which would cause it damage. Thus, the vent system not only protects against spilling of fuel during normal locomotive operation, but also prevents damage to the tank due to accidental overfilling during refueling.

To provide the above-described operation in a specific line of locomotives having fuel tank capacities up to four thousand gallons and in which the vent opening is located at a point about sixteen feet from the farthest end of the tank, a vent assembly is provided which includes a standpipe made from a $2\frac{1}{2}$ inch diameter steel pipe extending about twelve inches above the top of the tank and within an overflow vessel having a $2\frac{1}{2}$ inch outlet opening in the side and a contained volume below the drain opening of about 195 cubic inches. A baffle between the end of the standpipe and the outlet opening and extending down from the top of the overflow vessel to a level equal with the bottom of the outlet opening prevents fuel surging out of the standpipe from entering the drain conduit until the capacity of the overflow vessel is reached. A small $\frac{3}{8}$ inch return opening in the wall of the standpipe within and near the bottom of the overflow vessel allows for the return of liquid collected in the vessel back into the standpipe and thus to the fuel tank. The overall height of the installed vent assembly is less than 15 inches above the height of the fuel tank, and thus it is capable of installation within the space below the floor of the locomotive carbody but above the top of the fuel tank which is mounted beneath the carbody-supporting underframe.

While the invention has been described by specific reference to a single preferred embodiment, it should be understood that numerous changes could be made in the specific construction features of the described vent system without departing from the spirit and scope of the invention as disclosed herein. It is accordingly intended that the invention not be limited except by the language of the following claims.

What is claimed is:

1. A low height spill resistant pressure relieving vent in combination with a fuel tank mounted to a railway locomotive, said vent comprising a short standpipe mounted on the locomotive fuel tank and extending thereabove a sufficient height only to prevent any overflow of fuel therefrom under all conditions of braking deceleration of the locomotive that may occur prior to the terminal moments of a full stop, an enclosed overflow vessel having an inlet connected with the upper end of the standpipe and an outlet spaced from the standpipe, said vessel having a volume below the level of said outlet sufficient to contain the total quantity of fuel that may overflow the standpipe during said terminal moments of a full stop of the associated locomotive, baffle means in said overflow vessel and disposed between the standpipe and the outlet in position to prevent dynamic carryover of overflowed fuel from the standpipe to the outlet, and return means for returning overflowed fuel from said vessel to the associated fuel tank, said standpipe, said outlet and the flow path between them within said vessel being sufficiently large to pass fuel at a rate equal to the maximum flow rate of fuel filling equipment utilized to fill the tank without creating a back pressure sufficient to damage the tank whereby an open vent is provided that positively prevents fuel loss during locomotive operation and also prevents damage to the fuel tank due to pressurization or overfilling.

2. A fuel tank vent as defined in claim 1 wherein said standpipe extends upwardly substantially above the bottom of said overflow vessel and said return means comprises a return opening in said standpipe within and near the bottom of said overflow vessel, said return opening having a flow area at least one order of magnitude less than that of said standpipe to limit the fuel flow rate therethrough.

3. The combination in a railway locomotive of a frame having a pair of laterally spaced longitudinal center sill members and carbody portions extending above and laterally outwardly of said center sill members, a fuel tank secured to the frame below said center sill members and extending laterally outward under said carbody portions and vertically spaced therefrom with a predetermined clearance space therebetween, said tank mounting a low height spill resistant pressure relieving vent in said clearance space, said vent having a standpipe mounted on and extending upwardly from said tank a sufficient distance to prevent fuel overflow therefrom under the maximum conditions of braking deceleration of said locomotive prior to the terminal moments of a full stop, an enclosed overflow vessel on the upper end of said standpipe and connected therewith, said vessel having an outlet spaced from the standpipe and defining a volume below the level of said outlet sufficient to contain the total volume of fuel that may overflow the standpipe into the vessel due to peak deceleration rates reached during said terminal moments of a full stop of said locomotive, baffle means in said overflow vessel and disposed between said standpipe and said outlet in position to prevent dynamic carryover of overflowed fuel therebetween, and return means for returning fuel from the overflow vessel to fuel tank, said standpipe, said outlet and the flow path between them within said vessel being sufficiently large to pass fuel at the maximum flow rate at which the tank can be filled without creating a back pressure sufficient to damage the tank, whereby a below-carbody tank and vent assembly is provided that prevents tank damage due to pressurization due to overfilling as well as avoiding fuel loss from the tank during all normal locomotive operating conditions.

* * * * *